US011439881B1

(12) United States Patent
Nadel

(10) Patent No.: US 11,439,881 B1
(45) Date of Patent: Sep. 13, 2022

(54) PITCH TRAINING DEVICE

(71) Applicant: Richard Nadel, Winchester, MA (US)

(72) Inventor: Robert Geoffrey Nadel, Winchester, MA (US)

( * ) Notice: Subject to any disclaimer, the term of this patent is extended or adjusted under 35 U.S.C. 154(b) by 0 days.

(21) Appl. No.: 17/651,910

(22) Filed: Feb. 22, 2022

(51) Int. Cl.
*A63B 69/00* (2006.01)
*A63B 21/062* (2006.01)
*A63B 21/00* (2006.01)

(52) U.S. Cl.
CPC ..... *A63B 69/0002* (2013.01); *A63B 21/062* (2013.01); *A63B 21/154* (2013.01); *A63B 69/0091* (2013.01); *A63B 2069/0006* (2013.01)

(58) Field of Classification Search
CPC . A63B 69/0002; A63B 21/062; A63B 21/154; A63B 69/0091; A63B 2069/0006
USPC ..... 473/429, 422–428, 420, 451–457; 482/92, 93
See application file for complete search history.

(56) References Cited

U.S. PATENT DOCUMENTS 4,460,172 A * 7/1984 Hogan ..... A63B 69/0091 473/426
5,158,517 A * 10/1992 Steggert ..... A63B 21/0628 482/20
5,423,730 A * 6/1995 Hirsch ..... A63B 21/154 482/99
5,957,788 A * 9/1999 Eze ..... A63B 69/0091 473/422
7,217,202 B2 * 5/2007 Troxell ..... A63B 69/0002 473/428
7,445,569 B2 * 11/2008 Cornelio, Jr. ..... A63B 69/0002 482/121
7,517,290 B1 * 4/2009 Springer ..... A63B 69/0002 473/428
7,699,724 B1 * 4/2010 Derisse ..... A63B 69/0002 473/422
8,574,101 B2 * 11/2013 Wheelbarger ..... A63B 69/38 473/422
9,135,347 B2 9/2015 Damman et al.
2003/0087733 A1 * 5/2003 Kim ..... A63B 21/4035 482/93

(Continued)

FOREIGN PATENT DOCUMENTS

WO 0021617 A1 4/2000
WO 2009100393 A3 10/2009
WO 2015073929 A1 5/2015

*Primary Examiner* — Mitra Aryanpour
(74) *Attorney, Agent, or Firm* — Carson Patents; Gregory D Carson

(57) ABSTRACT

The Nadel Pitch Training Device is a pitch training device or apparatus in the form of an linearly extending attachment having a rotating connection point for connection to a baseball simulator that is attached to a three-dimensional resistance means for the purpose of providing strengthening, rehabilitation, and/or correct body motion mechanics training to improve pitching quality, speed, strength, and body mechanics that enables training, exercising, and rehabilitation of proper body motion mechanics for improving the act of pitching and increasing the performance (speed and/or accuracy) of the act by enabling weighted ball training wherein the weight of the ball is connected to and maintained in the center of the ball and the center of mass of the weight is maintained in the center (physical, geometric, and/or dimensional) of the ball.

18 Claims, 6 Drawing Sheets

(56) References Cited

U.S. PATENT DOCUMENTS

2006/0199673 A1* 9/2006 Littlejohn ..... A63B 69/0002
473/422

* cited by examiner

PITCH TRAINING DEVICE

TECHNICAL FIELD OF THE INVENTION

This invention relates generally to a pitch training device or apparatus in the form of an linearly extending attachment having a rotating connection point for connection to a baseball simulator that is attached to a resistance means for the purpose of providing strengthening, rehabilitation, and/or correct body motion mechanics training to improve pitching quality, speed, strength, and body mechanics.

This invention relates more specifically to a pitch training device or apparatus in the form of an linearly extending attachment having a rotating connection point for connection to a baseball simulator that is attached to a three-dimensional resistance means for the purpose of providing strengthening, rehabilitation, and/or correct body motion mechanics training to improve pitching quality, speed, strength, and body mechanics.

BACKGROUND

There are only limited devices, apparatus, and methods available for exercising and or rehabilitating the act of pitching a baseball. There are available today even fewer limited devices, apparatus, and methods available for teaching or training the proper and/or most effective and efficient body movements for performing the act of pitching a baseball.

Available today devices and apparatus that are normally weighted and added weight baseball sized balls, balls attached to strings and rods, and balls of various sizes attached to strings and/or rods connected to pulley's and weights to impart a force or resistance (weight) to the attached ball. Available today are a few options for physical therapy and/or training the proper body motion and mechanics involved in expert or professional player performance of the act of pitching that include the usual treatment and therapy modalities for assisting in healing and restoring proper body motion mechanics.

The devices, apparatus, and methods available all suffer from at least one of these limitations: the attachment for the string or rod to connect the ball is on the surface of the ball not from the center of the ball; the added weight shifts off-center away from the actual center of the ball inside the ball when used; and the attachment between the ball and any applied force of resistance is too flexible to transfer a mechanically applied force of resistance.

In light of the foregoing prior art, there is a need for a pitch training device or apparatus to better enable training, exercising, and rehabilitation of proper body motion mechanics for improving the act of pitching and increasing the performance (speed and/or accuracy) of the act. Further, there is a need for a pitch training device or apparatus that better enables connection to a ball at the center of the ball instead of the side or edge. Further, there is a need for a pitch training device or apparatus that better enables a weighted (applied force of resistance) connection to a ball at the center of the ball instead of the side or edge wherein the center of mass of the weight does not shift off-center within the ball.

BRIEF SUMMARY OF THE INVENTION

According to a first aspect of the invention there is a device for attachment to mechanical exercise training system enabling training people to pitch a baseball comprising a first scissor extender having a first connection base and a first connection end, a rotating ball joint having a rotating base, a first socket, a first ball, and a first connection rod, an angled rotating ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

According to a second aspect of the invention there is further a device or apparatus as in the first aspect wherein said rotating ball joint further comprises a first spherical sleeve inserted between said first ball and said first socket, and said angled rotating ball joint further comprises a second spherical sleeve inserted between said second ball and said second socket.

According to a third aspect of the invention there is further a device or apparatus as in the first aspect wherein said attachment rod is connectively attached to an axel having a first omnidirectional wheel and a second omnidirectional wheel at opposing ends.

According to a fourth aspect of the invention there is further a device or apparatus as in the third aspect wherein said axel further comprises at least a third omnidirectional wheel.

According to a fifth aspect of the invention there is further a device or apparatus as in the first aspect wherein said baseball simulator further comprises a ball joint having a third ball a third socket and a third connection rod wherein said attachment rod is connectively attached to said third connection rod.

According to a sixth aspect of the invention there is further a device or apparatus as in the fifth aspect wherein said ball joint further comprises a spherical sleeve inserted between said third ball and said third socket.

According to a seventh aspect of the invention there is further a device or apparatus as in the first aspect wherein said mechanical exercise training system further comprises a Three-dimensional resistance machine.

According to an eighth aspect of the invention there is further a device or apparatus as in the first aspect wherein said mechanical exercise training system further comprises a controlled motion three dimensional exercise machine.

According to a ninth aspect of the invention there is further a device or apparatus as in the first aspect further comprising a second scissor extender wherein said first scissor extender is operationally attached parallel to said second scissor extender.

According to a tenth aspect of the invention there is a device for attachment to mechanical exercise training system enabling training people to pitch a baseball comprising a first scissor extender having a first connection base and a first connection end, a rotating ball joint having a rotating base, a first socket, a first ball, and a first connection rod, a ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

According to an eleventh aspect of the invention there is further a device or apparatus as in the tenth aspect wherein said rotating ball joint further comprises a first spherical sleeve inserted between said first ball and said first socket, and said ball joint further comprises a second spherical sleeve inserted between said second ball and said second socket.

According to an twelfth aspect of the invention there is further a device or apparatus as in the tenth aspect wherein said attachment rod is connectively attached to an axel having a first omnidirectional wheel and a second omnidirectional wheel at opposing ends.

According to a thirteenth aspect of the invention there is further a device or apparatus as in the tenth aspect wherein said axel further comprises at least a third omnidirectional wheel.

According to a fourteenth aspect of the invention there is further a device or apparatus as in the tenth aspect wherein said baseball simulator further comprises a ball joint having a third ball a third socket and a third connection rod wherein said attachment rod is connectively attached to said third connection rod.

According to a fifteenth aspect of the invention there is further a device or apparatus as in the fourteenth aspect wherein said ball joint further comprises a spherical sleeve inserted between said third ball and said third socket.

According to a sixteenth aspect of the invention there is further a device or apparatus as in the tenth aspect wherein said mechanical exercise training system further comprises a Three-dimensional resistance machine.

According to a seventeenth aspect of the invention there is further a device or apparatus as in the tenth aspect wherein said mechanical exercise training system further comprises a controlled motion three dimensional exercise machine.

According to an eighteenth aspect of the invention there is further a device or apparatus as in the tenth aspect further comprising a second scissor extender wherein said first scissor extender is operationally attached parallel to said second scissor extender.

According to a nineteenth aspect of the invention there is a device for attachment to mechanical exercise training system enabling training people to pitch a baseball comprising a baseball simulator having an attachment rod.

According to an twentieth aspect of the invention there is further a device or apparatus as in the nineteenth aspect further comprising a ball joint having a rotating base having a connection base, a socket, a ball, and a connection rod wherein said attachment rod is connectively attached to said connection rod.

According to a twenty-first aspect of the invention there is further a device or apparatus as in the twentieth aspect wherein said ball joint further comprises a spherical sleeve inserted between said ball and said socket.

According to a twenty-second aspect of the invention there is further a device or apparatus as in the nineteenth aspect wherein said attachment rod is connectively attached to an axel having a first omnidirectional wheel and a second omnidirectional wheel at opposing ends.

According to a twenty-third aspect of the invention there is further a device or apparatus as in the twenty-second aspect wherein said axel further comprises at least a third omnidirectional wheel.

According to a twenty-fourth aspect of the invention there is further a device or apparatus as in the nineteenth aspect wherein said mechanical exercise training system further comprises a cable having a first connection end and a second connection end at opposing ends operationally positioning for movement over a pulley connectively attached to a weight.

According to a twenty-fifth aspect of the invention there is further a device or apparatus as in the twenty-fourth aspect wherein said mechanical exercise training system further comprises a an open frame and wherein said pulley is operationally attached to said open frame.

An advantage of the pitch training device or apparatus of the present invention is that it enables training, exercising, and rehabilitation of proper body motion mechanics for improving the act of pitching and increasing the performance (speed and/or accuracy) of the act. Further, the pitch training device or apparatus of the present invention enables connection to a ball at the center of the ball instead of the side or edge. Further, the pitch training device or apparatus of the present invention enables a weighted (applied force of resistance) connection to a ball at the center of the ball instead of the side or edge wherein the center of mass of the weight does not shift off-center within the ball.

The invention will now be described, by way of example only, with reference to the accompanying drawings as described below.

DETAILED DESCRIPTION

Figure 1:
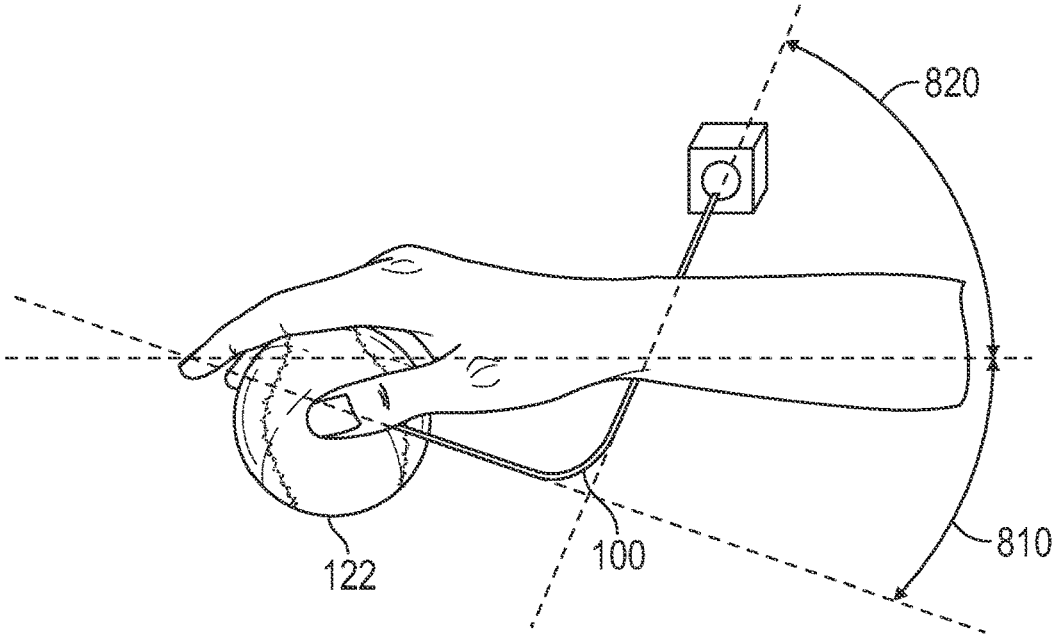
FIG. 1 is a perspective view of an a right hand holding the baseball simulator showing the Nadel Pitch Training Device attachment rod according to the invention.

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Throughout this specification, the phrase "mechanical exercise training system" will be understood to imply a training system and/or exercise system comprising a combination of one or more different exercise forms and/or physical rehabilitation therapies used to treat injuries and enhance physical performance in people.

Throughout this specification, the phrase "body motion mechanics" will be understood to imply the physical movements of a human body involved in mechanically accomplishing a given motion or movement based task.

Throughout this specification, the phrase "controlled motion three-dimensional exercise machine" or "three-dimensional exercise machine" or "three-dimensional resistance machine" will be understood to imply a mechanical means to provide a consistent, adjustable, or variable force of resistance at any point in a given volume that said device can move or articulate about within said volume. This includes that said mechanical means is able to provide a consistent, adjustable, or variable force of resistance at any point in a given volume that said device can move or articulate about within said volume across any path of motion that said mechanical means can move within.

INDEX OF LABELLED FEATURES IN FIGURES

Features are listed in numeric order by Figure in numeric order.

Referring to the Figures, there is shown in FIGS. 1 through 11 the following features:

Element 100 which is an attachment rod.

Element 102 which is a two wheeled axel.

Element 104 which is a five wheeled axel.

Element 110 which is a rotatable ball joint base.

Element 112 which is a rotatable connection head.

Element 120 which is a rotating ring, wherein element 120A is the right side and 120B is the left side.

Element 122 which is a baseball simulator.

Element 124 which is a ball joint connection baseball simulator.

Element 130 which is a ball joint.

Element 132 which is a rotating joint connection head receiver.

Element 134 which is a spherical socket shaped and dimensioned to mate to a ball as in element 150 below.

Element 140 which is a ball sleeve.

Element 150 which is a ball component of a ball joint as connected to a rod.

Element 160 which is a rotatable sleeved ball joint.

Element 162 which is a rotatable sleeved ball joint connection head.

Element 164 which is a spherical socket shaped and dimensioned to mate to a ball 150.

Element 170 which is a connection rod.

Element 180 which is an angled rotatable sleeved ball joint.

Element 182 which is an angled rotatable sleeved ball joint connection head.

Element 184 which is a spherical socket shaped and dimensioned to mate to a ball 150.

Element 210 which is an omnidirectional wheel.

Element 300 which is a single scissor extender.

Element 310 which is a scissor extender base for connection to an external apparatus or device.

Element 320 which is a scissor extender base external sliding sleeve.

Element 322 which is a scissor extender base internal sliding sleeve.

Element 330 which is an extension tab.

Element 335 which is an extension tab rotating joint.

Element 340 which is a scissor arm.

Element 345 which is a scissor arm rotating joint.

Element 350 which is a scissor arm end.

Element 355 which is a scissor arm end rotating joint.

Element 360 which is a scissor arm center rotating joint.

Element 370 which is a scissor arm connection end.

Element 410 which is a cable.

Element 420 which is a pulley.

Element 430 which is a weight.

Element 440 which is an open frame.

Element 450 which is an open frame base.

Element 540 which is a dual scissor arm.

Element 545 which is a dual scissor arm rotating joint.

Element 550 which is a dual scissor arm end.

Element 555 which is a dual scissor arm end rotating joint.

Element 560 which is a dual scissor arm center rotating joint.

Element 570 which is a dual scissor arm connection end.

Feature 810 is showing the angle of arc between the centerline of a right arm holding a baseball simulator 122 and the angle of departure of the attachment rod 100.

Feature 820 is showing the angle of arc between the centerline of the attachment rod 100 as it extends away from the hand shown holding the baseball simulator 122 and the centerline of the right arm.

Feature 830 is showing the angle of arc between the centerline of a right arm holding a baseball simulator 122 and the angle of departure of a curved version of the attachment rod 100 anterior to the sagittal (lateral) plane of the human body to which said right arm would be attached.

Feature 840 is showing the angle of arc between the centerline of a right arm holding a baseball simulator 122 and the angle of departure of a bent version of the attachment rod 100 anterior to the sagittal (lateral) plane of the human body to which said right arm would be attached.

Feature 850 is showing the angle of arc between opposing ends of a curved version of the attachment rod 100.

Feature 860 is showing the angle of arc between opposing ends of a bent version of the attachment rod 100.

Feature 870 is showing the angle of arc between a rotatable sleeved ball joint 160 and an angled rotatable ball joint 180.

This invention relates generally to a pitch training device or apparatus in the form of an linearly extending attachment having a rotating connection point for connection to a baseball simulator that is attached to a resistance means for the purpose of providing strengthening, rehabilitation, and/or correct body motion mechanics training to improve pitching quality, speed, strength, and body mechanics.

This invention relates specifically to a pitch training device or apparatus in the form of an linearly extending attachment having a rotating connection point for connection to a baseball simulator that is attached to a three-dimensional resistance means for the purpose of providing strengthening, rehabilitation, and/or correct body motion mechanics training to improve pitching quality, speed, strength, and body mechanics.

Making the device of the present invention can be accomplished to achieve utility with any weight or force of resistance up to at least ten kilograms. However, the best known weight or force of resistance range for exercise, training, and rehabilitation of the muscles and body motion mechanics involved in the act of pitching a baseball are known to be most usefully limited to weights or forces of resistance up to one approximately one kilogram, and weights or forces of resistance up to five kilograms.

Making the device of the present invention involves the use of any suitable material capable of providing a strength to weight ratio sufficient to maintain the rigidity of the device when extended up to two meters from a surface to which it is attached. Various solid metal rods and hollow metal tubes made from stainless steel, carbon fiber, and some higher strength plastics are readily suited to use to embody the present invention.

The device or apparatus of the present invention starts at the connection of a baseball simulator 122 wherein an attachment rod 100 is inserted into the baseball simulator 122 passing through the exterior of the baseball simulator 122 and terminating at the center of the baseball simulator 122. Termination in the center means that the attachment rod extends inward towards and extending to the physical, geographic, and/or dimensional center of the baseball simulator 122.

Figure 3:
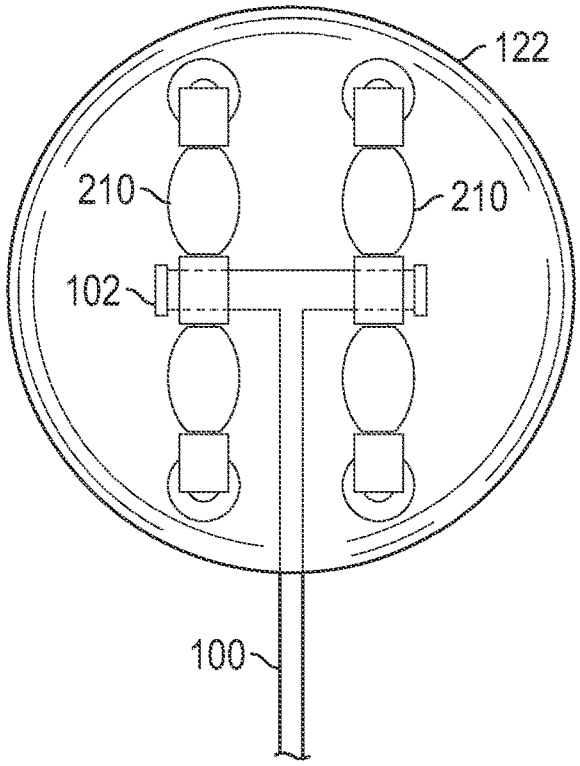
FIG. 3 is a perspective view of the baseball simulator showing the attachment rod connected to an axel having two omnidirectional wheels attached which are freely rotatable internally mounted according to the invention.
Figure 4:
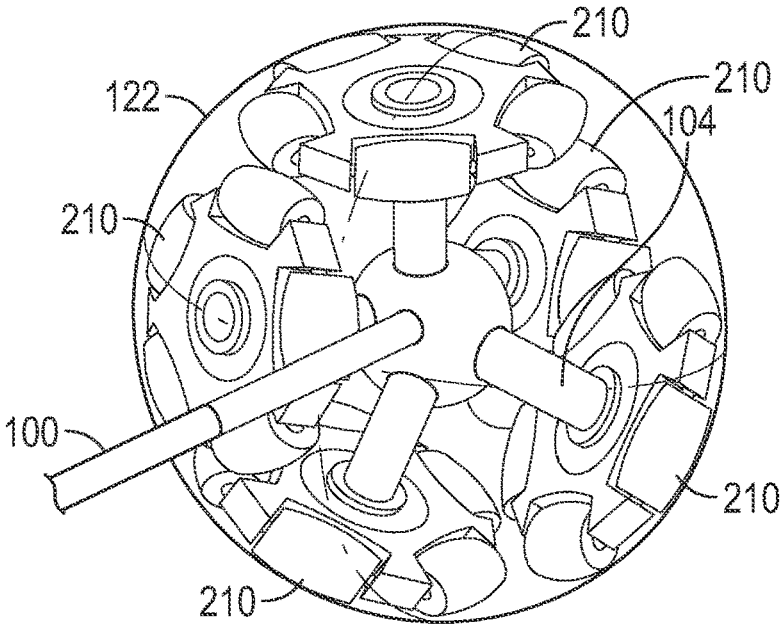
FIG. 4 is a perspective view of the baseball simulator showing the attachment rod connected to an axel having five omnidirectional wheels attached which are freely rotatable internally mounted according to the invention.
Figure 5:
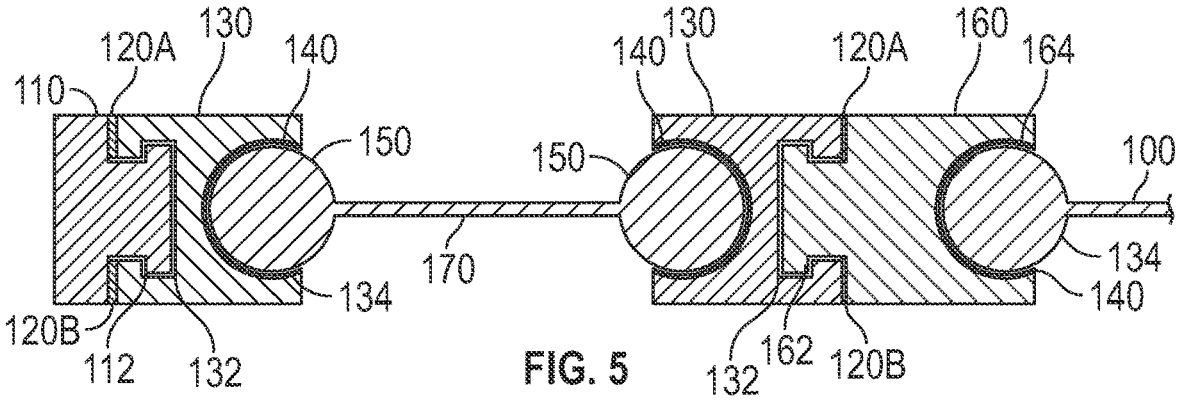
FIG. 5 is a cross section view of the straight connection rotatable ball joints showing a rotatable ball joint base having a sleeved ball joint and a dual ball joint straight connection rotatable ball joint having a sleeved ball joint and a rotatable sleeved ball joint according to the invention.
Figure 6:
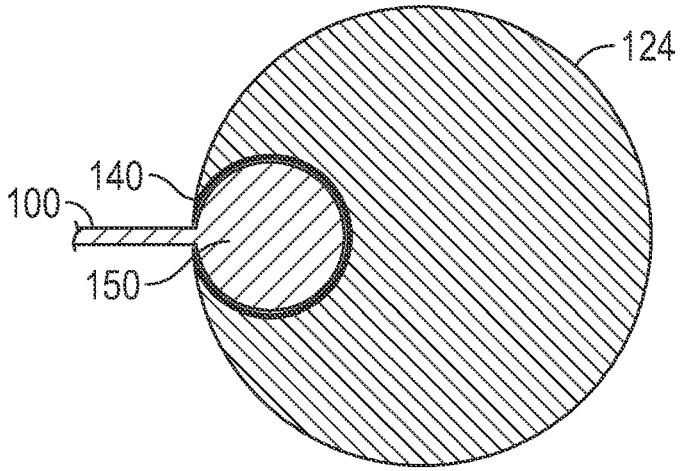
FIG. 6 is a cross section view of an alternate baseball simulator showing the ball joint used in said alternate baseball simulator to connect to the attachment rod according to the invention.
Figure 7:
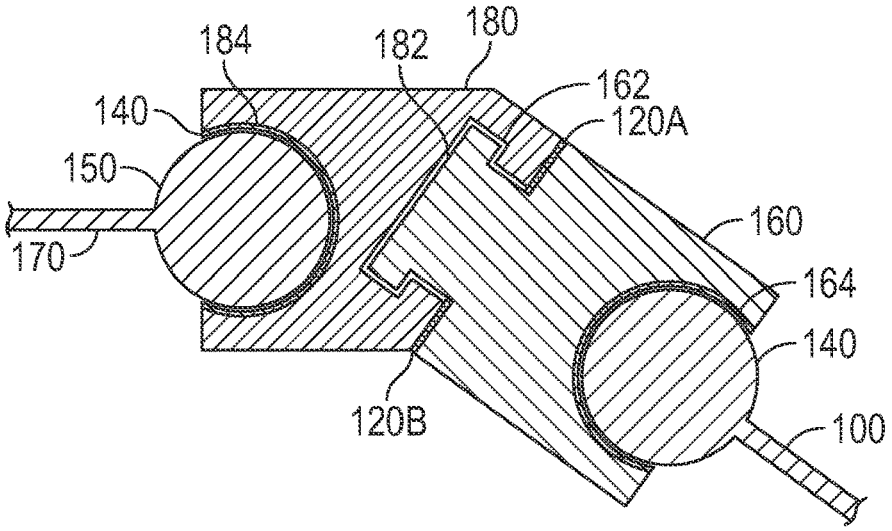
FIG. 7 is a cross section view of the angled connection rotatable ball joint showing a an angled rotatable joint and the sleeved ball joints of said angled connection rotatable ball joint according to the invention.

There is at least the two means presented herein, and shown in FIG. 3 and FIG. 4, to enable the spin or rotation of a baseball simulator 122 about an attached attachment rod 100 connected to the center of a baseball simulator 122. First the two wheel axel 102 and second the five wheeled axel 104. Each axel has connected an omnidirectional wheel 210 connected at each wheel position to enable spin and/or rotation of an attached attachment rod 100 and thus the spin or rotation of the baseball simulator 122 about the attachment rod 100. Further, there is at least the means presented herein, and shown in FIG. 9 to enable the spin or rotation of a baseball simulator 122 about an attached attachment rod 100 connected to the interior of a baseball simulator 122 using a ball joint 130 and a spherical socket 134.

Figure 8:
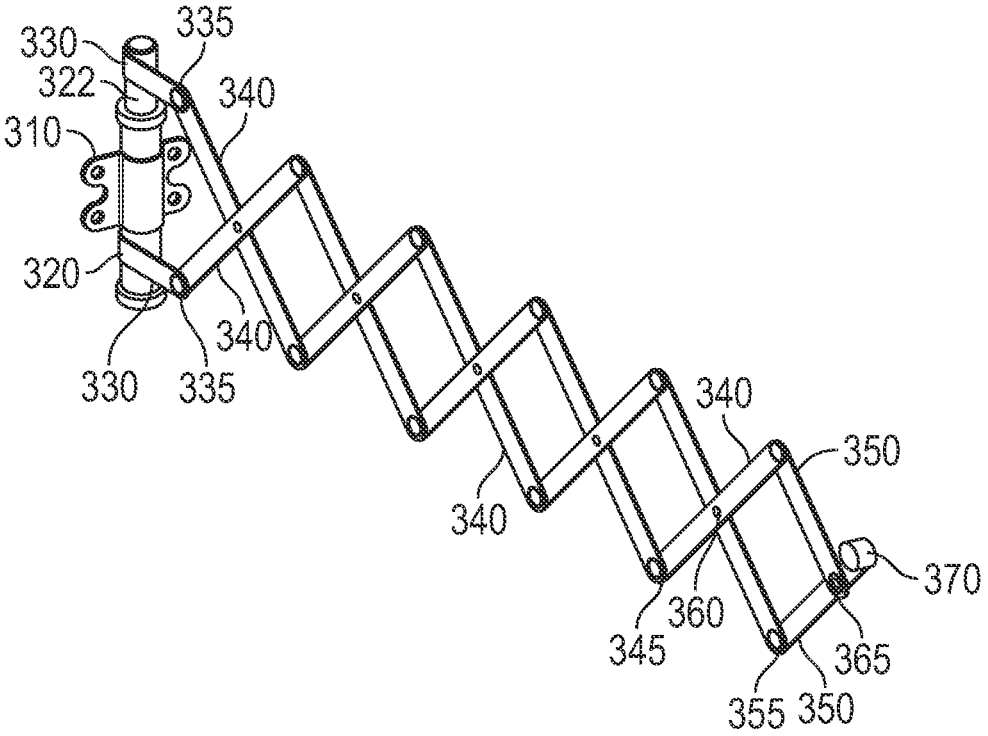
FIG. 8 is a perspective view of a single scissor extender according to the invention.
Figure 9:
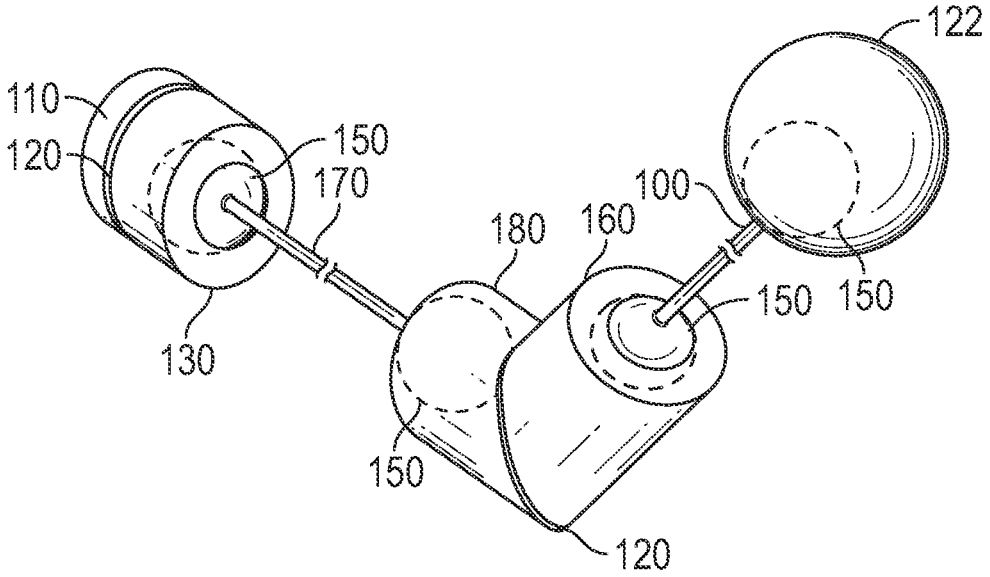
FIG. 9 is a perspective view of the baseball simulator's attachment rod connected to an angled connection rotatable ball joint which is then connected to a base straight connection rotatable ball joint showing the ball joint used in said alternate baseball simulator to connect to the attachment rod according to the invention.
Figure 10:
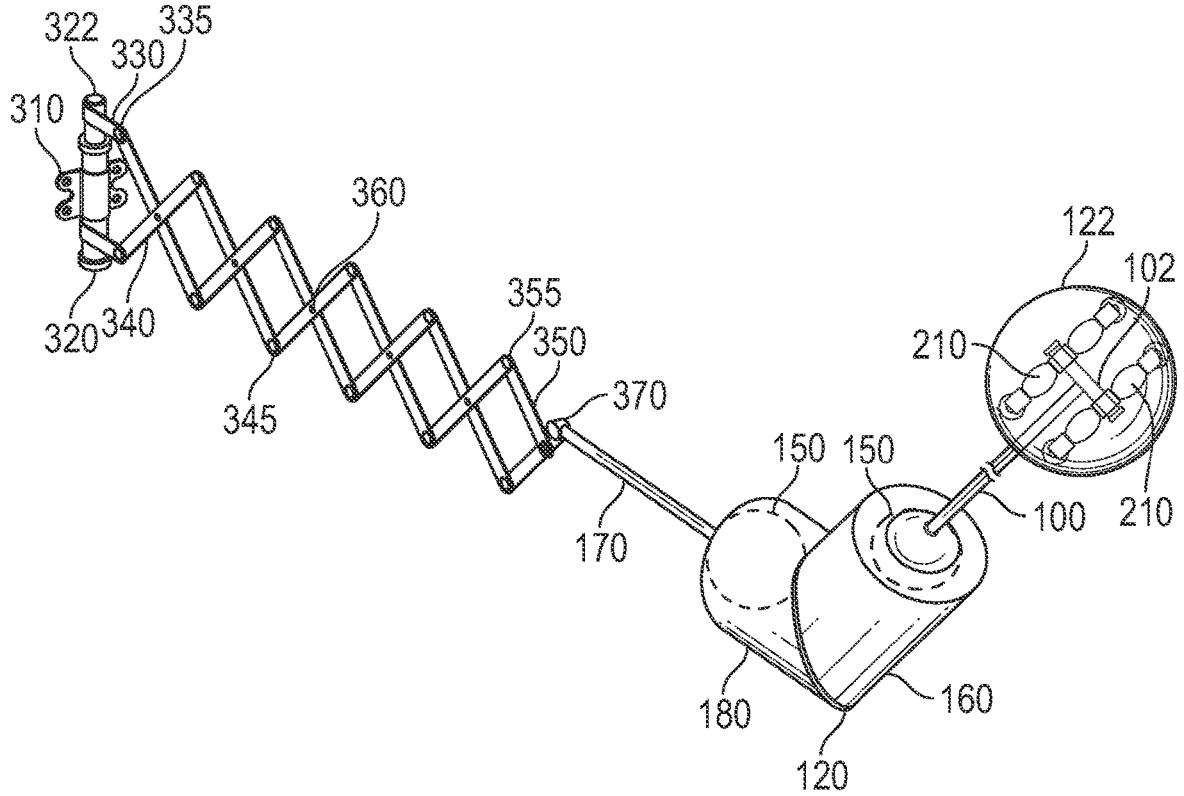
FIG. 10 is a perspective view of a single scissor extender attached to an angled rotatable ball joint connected to the baseball simulator according to the invention.
Figure 11:
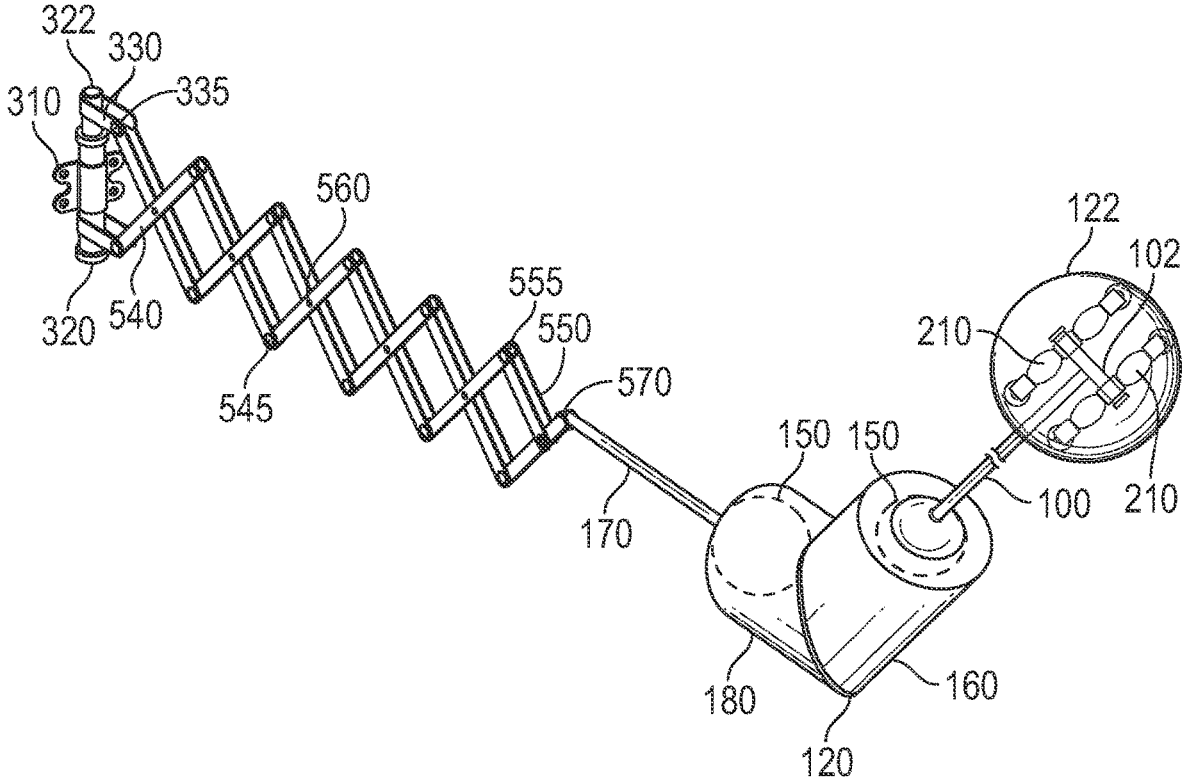
FIG. 11 is a perspective view of a dual scissor extender attached to an angled rotatable ball joint connected to the baseball simulator according to the invention.
Figure 12:
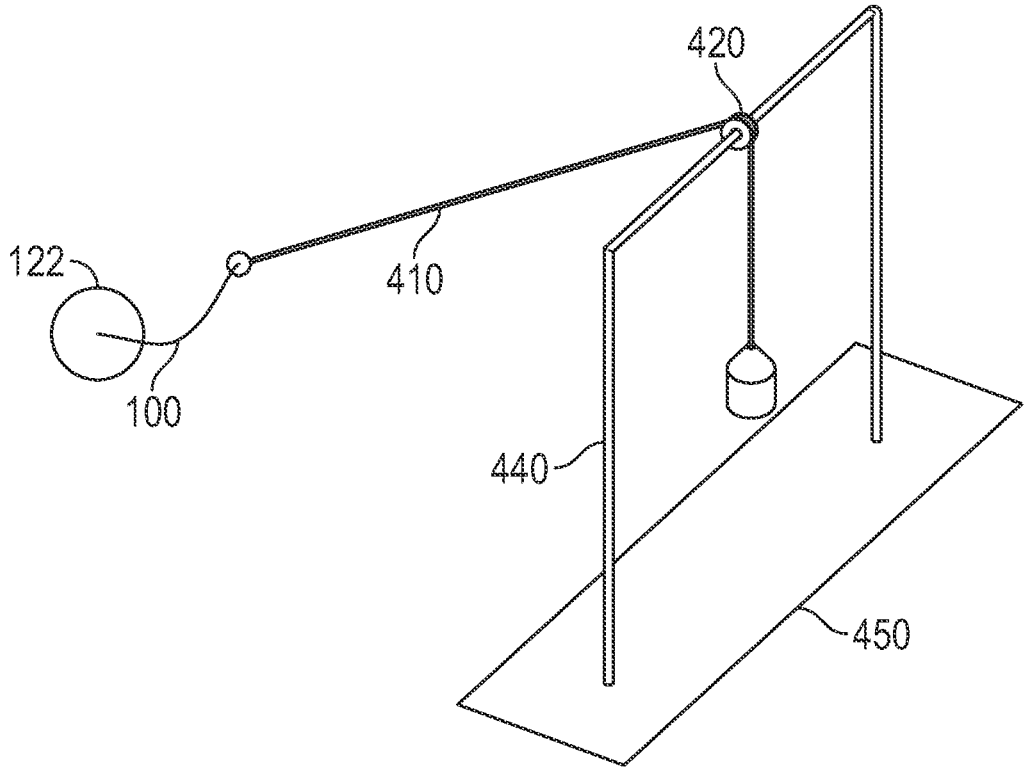
FIG. 12 is a perspective view of a baseball simulator showing the attachment rod connected to a cable over a pulley having a weight attached according to the invention.

Connecting the attachment rod 100 to a linear motion system such as the scissor extender shown in FIG. 8 and FIG. 10, or the dual scissor extender shown in FIG. 11 is done to enable the extension away from an attachment surface of a controlled motion three-dimensional exercise machine, three-dimensional exercise machine, or Three-dimensional resistance machine. A single or dual scissor extender can be made to extend and carry the weight or force of resistance from the surface to which it is attached to an attached attachment rod 100 to a distance of up to two meters by varying the materials of the scissor extender components or elements comprising a scissor extender base 310 having an external sliding sleeve 320 with an internal sliding sleeve 322 for attachment to a controlled motion three-dimensional exercise machine or three-dimensional exercise machine and extension away therefrom wherein a pair of extension tabs 330 having an extension tab rotating joint 335 for connection to a plurality of scissor arms 340 having scissor arm rotating joints 345 and scissor arm center rotating joints 360 and an end pair of scissor arm ends 350 connected to a scissor arm end rotation joint 355 having a scissor arm connection end 370 for attaching either an attachment rod 100 or rotatable ball joint 130 with or without a ball sleeve 140.

Creating a rotatable and extendable connection is additionally embodied in using a combination of a rotatable ball joint base 110 having a rotatable connection head 112 used with or without a rotating ring 120 wherein said rotatable connection head 112 is inserted to enable operationally spinning into a rotating joint connection head receiver 132 element of a ball joint 130 for mating and connection to ball component 150 used with or without a ball sleeve 140. This combination may be further extended by further incorporating at least one rotating ball joint comprising a rotatable sleeved ball joint 160 having a rotatable sleeved ball joint connection head 162 and spherical socket 164 and or at least one angled rotating ball joint comprising an angled rotatable sleeved ball joint 180 having an angled rotatable sleeved ball joint connection head 182 and spherical socket 184 using connection rods 170 to connect ball components 150 thereby enabling rotating or spinning extendable connections.

In an embodiment of a manufacturing method there are engineered dimensions for all elements of the present invention such that tolerances in dimension and dimensional match between elements are designed to result in an ease of movement or smoothness of movement of the device or apparatus of the present invention.

In an alternate embodiment of a manufacturing method there are additional bands, not shown, wrapped about and around the rotating ball joints of all types to tighten the connection and control or limit the movement of the rotating ball joint to tighten the ball joint connection between the ball and the socket.

Figure 2:
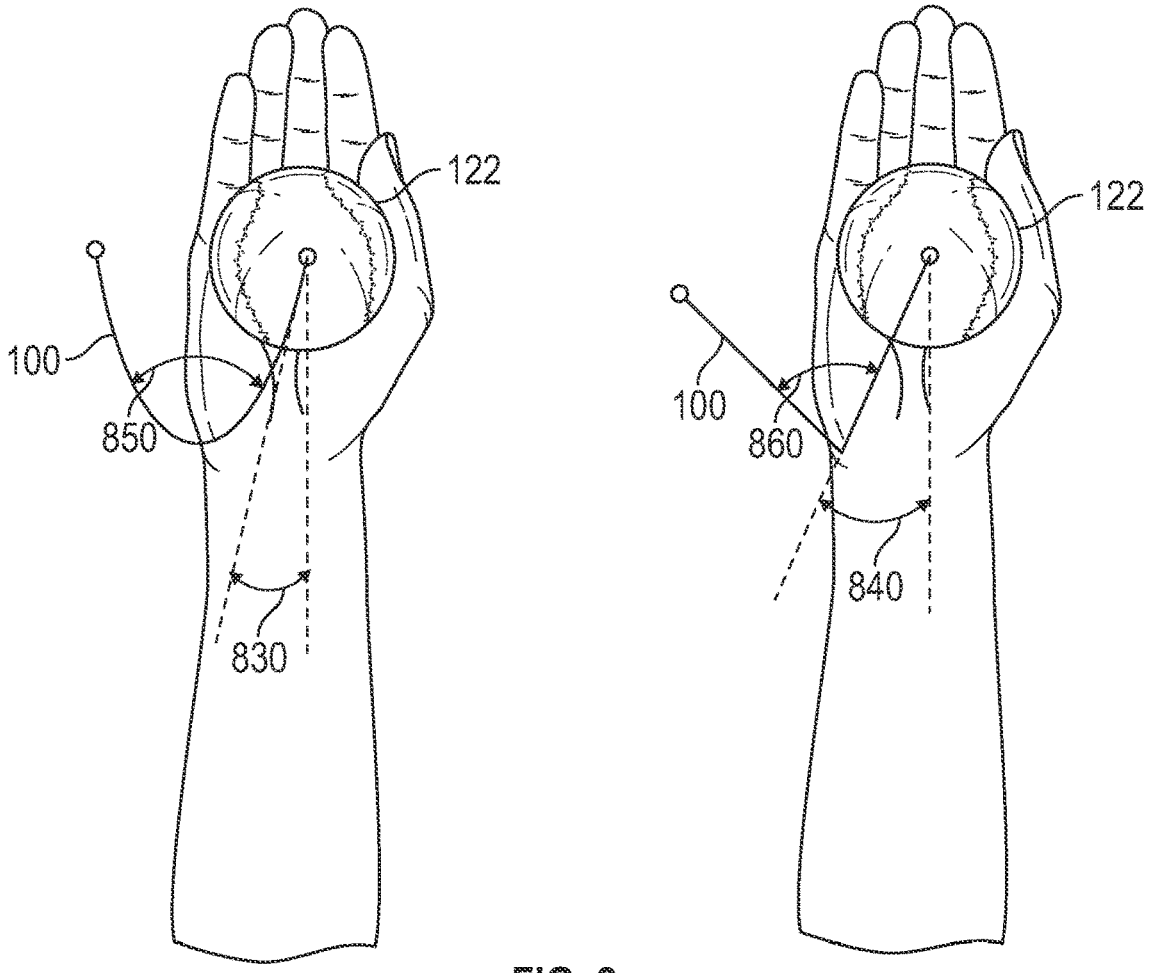
FIG. 2 is two bottom views of a right hand holding the baseball simulator showing the attachment rod in two configurations according to the invention.

Regarding the attachment rod 100 and the angles as shown in FIG. 1, FIG. 2, and FIG. 3: arc 810 is showing the angle of arc between the centerline of a right arm holding a baseball simulator 122 and the angle of departure of the attachment rod 100; arc 820 is showing the angle of arc between the centerline of the attachment rod 100 as it extends away from the hand shown holding the baseball simulator 122 and the centerline of the right arm; arc 830 is showing the angle of arc between the centerline of a right arm holding a baseball simulator 122 and the angle of departure of a curved version of the attachment rod 100 anterior to the sagittal (lateral) plane of the human body to which said right arm would be attached; arc 840 is showing the angle of arc between the centerline of a right arm holding a baseball simulator 122 and the angle of departure of a bent version of the attachment rod 100 anterior to the sagittal (lateral) plane of the human body to which said right arm would be attached; arc 850 is showing the angle of arc between opposing ends of a curved version of the attachment rod 100; arc 860 is showing the angle of arc between opposing ends of a bent version of the attachment rod 100, and arc 870 is showing the angle of arc between a rotatable sleeved ball joint 160 and an angled rotatable ball joint 180.

Arc 810 may be any angle or degrees of arc up to 180 degrees, but is best suited to training, exercise, and rehabilitation when more less than 45 degrees, and is fully operational at about 7 to 15 degrees. Arc 820 may be any angle or degrees of arc up to 180 degrees, but is best suited to training, exercise, and rehabilitation when more than 45 degree and less than 135 degrees, and is fully operational at about 90 degrees. Arc 830 may be any angle or degrees of arc up to 180 degrees, but is best suited to training, exercise, and rehabilitation when more less than 90 degrees, and is fully operational at about 15 to 45 degrees. Arc 840 may be any angle or degrees of arc up to 180 degrees, but is best suited to training, exercise, and rehabilitation when more less than 90 degrees, and is fully operational at about 15 to 45 degrees. Arc 850 may be any angle or degrees of arc up to 180 degrees, but is best suited to training, exercise, and rehabilitation when more than 45 degree and less than 135 degrees, and is fully operational at about 90 degrees. Arc 860 may be any angle or degrees of arc up to 180 degrees, but is best suited to training, exercise, and rehabilitation when more than 45 degree and less than 135 degrees, and is fully operational at about 90 degrees.

In a first embodiment there is a device for attachment to mechanical exercise training system enabling training people to pitch a baseball comprising a first scissor extender having a first connection base and a first connection end, a rotating ball joint having a rotating base, a first socket, a first ball, and a first connection rod, an angled rotating ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

In an alternate embodiment there is a device as in the first embodiment wherein said rotating ball joint further comprises a first spherical sleeve inserted between said first ball and said first socket, and said angled rotating ball joint further comprises a second spherical sleeve inserted between said second ball and said second socket.

In an alternate embodiment there is a device as in the first embodiment wherein said attachment rod is connectively attached to an axel having a first omnidirectional wheel and a second omnidirectional wheel at opposing ends, and further wherein said axel further comprises at least a third omnidirectional wheel.

In an alternate embodiment there is a device as in the first embodiment wherein said baseball simulator further comprises a ball joint having a third ball a third socket and a third connection rod wherein said attachment rod is connectively attached to said third connection rod, and an alternate embodiment wherein said ball joint further comprises a spherical sleeve inserted between said third ball and said third socket.

In an alternate embodiment there is a device as in the first embodiment wherein said mechanical exercise training system further comprises a Three-dimensional resistance machine.

In an alternate embodiment there is a device as in the first embodiment wherein said mechanical exercise training system further comprises a controlled motion three dimensional exercise machine.

In an alternate embodiment there is a device as in the first embodiment further comprising a second scissor extender wherein said first scissor extender is operationally attached parallel to said second scissor extender.

In a second preferred embodiment there is a device for attachment to a mechanical exercise training system enabling training people to pitch a baseball comprising a first scissor extender having a first connection base and a first connection end, a rotating ball joint having a rotating base, a first socket, a first ball, and a first connection rod, a ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

In an alternate embodiment there is a device as in the second embodiment wherein said rotating ball joint further comprises a first spherical sleeve inserted between said first ball and said first socket, and said ball joint further comprises a second spherical sleeve inserted between said second ball and said second socket.

In an alternate embodiment there is a device as in the second embodiment wherein said attachment rod is connectively attached to an axel having a first omnidirectional wheel and a second omnidirectional wheel at opposing ends.

In an alternate embodiment there is a device as in the second embodiment wherein said axel further comprises at least a third omnidirectional wheel.

In an alternate embodiment there is a device as in the second embodiment wherein said baseball simulator further comprises a ball joint having a third ball a third socket and a third connection rod wherein said attachment rod is connectively attached to said third connection rod, and an alternate embodiment wherein said ball joint further comprises a spherical sleeve inserted between said third ball and said third socket.

In an alternate embodiment there is a device as in the second embodiment wherein said mechanical exercise training system further comprises a Three-dimensional resistance machine.

In an alternate embodiment there is a device as in the second embodiment wherein said mechanical exercise training system further comprises a controlled motion three dimensional exercise machine.

In an alternate embodiment there is a device as in the second embodiment further comprising a second scissor extender wherein said first scissor extender is operationally attached parallel to said second scissor extender.

In a third embodiment there is a device for attachment to mechanical exercise training system enabling training people to pitch a baseball comprising a baseball simulator having an attachment rod.

In an alternate embodiment there is a device as in the third embodiment further comprising a ball joint having a rotating base having a connection base, a socket, a ball, and a connection rod wherein said attachment rod is connectively attached to said connection rod, and an alternate wherein said ball joint further comprises a spherical sleeve inserted between said ball and said socket.

In an alternate embodiment there is a device as in the third embodiment wherein said attachment rod is connectively attached to an axel having a first omnidirectional wheel and a second omnidirectional wheel at opposing ends, and an alternate wherein said axel further comprises at least a third omnidirectional wheel.

In an alternate embodiment there is a device as in the third embodiment wherein said mechanical exercise training system further comprises a cable having a first connection end and a second connection end at opposing ends operationally positioning for movement over a pulley connectively attached to a weight, and an alternate embodiment wherein said mechanical exercise training system further comprises a an open frame and wherein said pulley is operationally attached to said open frame.

An advantage of the pitch training device or apparatus of the present invention is that it enables training, exercising, and rehabilitation of proper body motion mechanics for improving the act of pitching and increasing the performance (speed and/or accuracy) of the act by enabled weighted ball training wherein the weight of the ball is connected to and maintained in the center of the ball and the center of mass of the weight is maintained in the center (physical, geometric, and/or dimensional) of the ball.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A device for attachment to mechanical exercise training system enabling training people to pitch a baseball comprising a first scissor extender having a first connection base and a first connection end, a rotating ball joint having a rotating base, a first socket, a first ball, and a first connection rod, an angled rotating ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

2. The device of claim 1 wherein said rotating ball joint further comprises a first spherical sleeve inserted between said first ball and said first socket, and said angled rotating ball joint further comprises a second spherical sleeve inserted between said second ball and said second socket.

3. The device of claim 1 wherein said attachment rod is connectively attached to an axel having a first omnidirectional wheel and a second omnidirectional wheel at opposing ends.

4. The device of claim 3 wherein said axel further comprises at least a third omnidirectional wheel.

5. The device of claim 1 wherein said baseball simulator further comprises a ball joint having a third ball a third socket and a third connection rod wherein said attachment rod is connectively attached to said third connection rod.

6. The device of claim 5 wherein said ball joint further comprises a spherical sleeve inserted between said third ball and said third socket.

7. The device of claim 1 wherein said mechanical exercise training system further comprises a Three-dimensional resistance machine.

8. The device of claim 1 wherein said mechanical exercise training system further comprises a controlled motion three dimensional exercise machine.

9. The device of claim 1 further comprising a second scissor extender wherein said first scissor extender is operationally attached parallel to said second scissor extender.

10. A device for attachment to mechanical exercise training system enabling training people to pitch a baseball comprising a first scissor extender having a first connection base and a first connection end, a rotating ball joint having a rotating base, a first socket, a first ball, and a first connection rod, a ball joint having a base, a second socket, a second ball, and a second connection rod, and a baseball simulator having an attachment rod wherein said first connection end is connectively attached to said first connection rod, said rotating base is operationally attached to said base, said attachment rod is connectively attached to said second connection rod.

11. The device of claim 10 wherein said rotating ball joint further comprises a first spherical sleeve inserted between said first ball and said first socket, and said ball joint further comprises a second spherical sleeve inserted between said second ball and said second socket.

12. The device of claim 10 wherein said attachment rod is connectively attached to an axel having a first omnidirectional wheel and a second omnidirectional wheel at opposing ends.

13. The device of claim 10 wherein said axel further comprises at least a third omnidirectional wheel.

14. The device of claim 10 wherein said baseball simulator further comprises a ball joint having a third ball a third socket and a third connection rod wherein said attachment rod is connectively attached to said third connection rod.

15. The device of claim 14 wherein said ball joint further comprises a spherical sleeve inserted between said third ball and said third socket.

16. The device of claim 10 wherein said mechanical exercise training system further comprises a Three-dimensional resistance machine.

17. The device of claim 10 wherein said mechanical exercise training system further comprises a controlled motion three dimensional exercise machine.

18. The device of claim 10 further comprising a second scissor extender wherein said first scissor extender is operationally attached parallel to said second scissor extender.

* * * * *